US009310170B1

(12) United States Patent
Basewitz

(10) Patent No.: US 9,310,170 B1
(45) Date of Patent: Apr. 12, 2016

(54) MOVEABLE FURNITURE PIECE WITH ARMORED PANEL

(71) Applicant: Alan Basewitz, Collingswood, NJ (US)

(72) Inventor: Alan Basewitz, Collingswood, NJ (US)

( * ) Notice: Subject to any disclaimer, the term of this patent is extended or adjusted under 35 U.S.C. 154(b) by 0 days.

(21) Appl. No.: 13/827,791

(22) Filed: Mar. 14, 2013

(51) Int. Cl.
*F41H 5/26* (2006.01)
*F41H 5/06* (2006.01)

(52) U.S. Cl.
CPC ... *F41H 5/26* (2013.01); *F41H 5/06* (2013.01)

(58) Field of Classification Search
CPC ..... F41H 5/06; F41H 5/08; F41H 5/14; F41H 5/24; F41H 7/00; F41H 7/005; F41H 5/26
USPC ..... 89/36.07, 36.09, 918, 920, 929, 938; 86/50; 109/22, 49.5, 51, 52, 64, 78, 79, 109/58; 292/259 R, 288; 312/107.5
See application file for complete search history.

(56) References Cited

U.S. PATENT DOCUMENTS

| | | | | | |
|---|---|---|---|---|---|
| 377,732 | A * | 2/1888 | Adams | 2/2.5 |
| 1,304,541 | A * | 5/1919 | Clark | 89/36.09 |
| 1,338,372 | A * | 4/1920 | Kammerich | 109/11 |
| 2,209,654 | A * | 7/1940 | Loeser, Jr. | 89/36.09 |
| 2,348,416 | A * | 5/1944 | Posey | 108/11 |
| 2,772,450 | A * | 12/1956 | Stewart | 49/388 |
| 3,590,685 | A * | 7/1971 | Lane | 89/36.09 |
| 4,316,286 | A | 2/1982 | Klein | |
| 4,349,223 | A * | 9/1982 | Spector | 292/259 R |
| 4,709,659 | A * | 12/1987 | Quante et al. | 109/21.5 |
| 5,293,807 | A * | 3/1994 | Hajdu | 89/36.07 |
| 5,554,816 | A | 9/1996 | Skaggs et al. | |
| 5,939,658 | A * | 8/1999 | Muller | 89/36.04 |
| 6,009,790 | A | 1/2000 | Tekorius | |
| 6,622,607 | B1 * | 9/2003 | Miller | 89/36.07 |
| 6,817,687 | B1 * | 11/2004 | Neeld et al. | 312/351.1 |
| 7,520,207 | B1 * | 4/2009 | Fuqua et al. | 89/36.07 |

(Continued)

FOREIGN PATENT DOCUMENTS

| | | | | |
|---|---|---|---|---|
| WO | WO 2013/117931 A2 * | 8/2013 | | E04B 2/74 |
| WO | WO 2014/127400 A1 * | 8/2014 | | F41H 5/06 |

OTHER PUBLICATIONS

Web Urbanist, "Hidden Beauty: Savvy Secret Room & Passageway Engineers," Internet article, archived on Jan. 15, 2013 at https://web.archive.org/web/20130117054521/http://weburbanist.com/2013/01/15/hidden-beauty-savvy-secret-room-passageway-engineers/, pp. 1-4.*

*Primary Examiner* — Bret Hayes
(74) *Attorney, Agent, or Firm* — Drinker Biddle & Reath LLP

(57) ABSTRACT

A furniture piece includes at least one armored panel and at least one locking mechanism wherein the at least one locking mechanism permits the at least one armored panel to be secured to a location adjacent to and substantially blocking at least one entrance of a room. The furniture piece may further include a furniture mobility mechanism, such as a wheel, a caster, a roller, a bearing, a sphere, a hemisphere, a cylinder, a skid or a slide. The furniture mobility mechanism may be selectable between a first "storage" position and a second "mobility" position, the second "mobility" position configured to assist in repositioning the furniture piece to the location adjacent to and substantially blocking the at least one entrance of the room. The furniture piece may be a bookcase, a wardrobe, a cabinet, a storage container, a shelf system, a wall hanging, a chalkboard, a whiteboard, a poster board, a desk and a table, and the locking mechanism may include a hook at a ring.

24 Claims, 5 Drawing Sheets

(56) References Cited

U.S. PATENT DOCUMENTS

| | | | | |
|---|---|---|---|---|
| 8,015,910 | B1 * | 9/2011 | Fuqua et al. | 89/36.09 |
| 8,850,949 | B1 * | 10/2014 | Lopez | 89/36.04 |
| 2001/0050517 | A1 | 12/2001 | Spitzer et al. | |
| 2002/0108529 | A1 * | 8/2002 | Trujillo | 104/165 |
| 2002/0130219 | A1 * | 9/2002 | Parseghian et al. | 244/118.6 |
| 2003/0008097 | A1 | 1/2003 | Durst et al. | |
| 2003/0161750 | A1 | 8/2003 | Moxson et al. | |
| 2003/0167911 | A1 * | 9/2003 | White | 89/36.07 |
| 2003/0213359 | A1 * | 11/2003 | Kropf | 89/36.09 |
| 2005/0284829 | A1 | 12/2005 | Shaffer | |
| 2005/0285012 | A1 | 12/2005 | Walton | |
| 2006/0138915 | A1 * | 6/2006 | Goldberg | 312/223.3 |
| 2006/0243126 | A1 * | 11/2006 | Tyler | 89/36.01 |
| 2007/0125012 | A1 * | 6/2007 | Quigley et al. | 52/167.1 |
| 2008/0079338 | A1 | 4/2008 | Van Dyke | |
| 2008/0263958 | A1 * | 10/2008 | Edson | 49/56 |
| 2009/0020241 | A1 | 1/2009 | Bowlware | |
| 2010/0187959 | A1 | 7/2010 | Agneloni | |
| 2011/0197746 | A1 * | 8/2011 | Melrose et al. | 89/36.02 |
| 2011/0278879 | A1 * | 11/2011 | Belanger et al. | 296/187.01 |
| 2012/0090452 | A1 | 4/2012 | Sudhakar | |
| 2012/0152096 | A1 | 6/2012 | Peters | |
| 2012/0247313 | A1 | 10/2012 | Peters | |
| 2014/0008359 | A1 * | 1/2014 | Ferren | 220/1.5 |
| 2014/0199678 | A1 * | 7/2014 | Tunis et al. | 434/408 |
| 2015/0096471 | A1 * | 4/2015 | Kyler | 108/15 |

* cited by examiner

MOVEABLE FURNITURE PIECE WITH ARMORED PANEL

FIELD OF THE INVENTION

The present invention relates generally to an armored or bullet-resistant furniture piece, such as a bookcase, desk or other item of furniture, that may be used as a moveable, securable barricade to substantially block a doorway or entrance to a room, for example a classroom, against a hostile intruder. More particularly, the furniture piece may be a bookcase with wheels or some other form of roller mechanism at the base to permit the bookcase to be easily repositioned from its normal location along a wall of the room to a location blocking all or substantially all of the doorway and a vertical back panel armored to withstand gunfire or other forms of attack. The furniture piece may also incorporate any of a number of simple, mechanical locking mechanisms to secure the piece to the door frame or wall surrounding the doorway. In this manner, a doorway or entrance to a room may be quickly and easily secured against an armed or unarmed attacker without the need for more costly or complicated alternatives.

BACKGROUND

Armed, random violence in schools, universities, workplaces and other public venues is one of the most horrifying and vexing problems facing the United States. Recently, a mentally disturbed former student was responsible for killing young schoolchildren at an elementary school in Newtown, Conn., which has prompted considerable discussion about how to prevent such attacks in the future. These attacks, however, are disturbingly frequent—with recent incidents at schools in Oakland, Calif., Toulouse, France, Jacksonville, Fla., Chardon, Ohio, Omaha, Nebr., Madison, Ala., Winnenden, Germany, Kauhajoki, Finland, DeKalb, Ill., Blacksburg, Va., and many other places.

Offices, other workplaces, malls, movie theaters, public facilities and even places of worship have also been the location of significant gun violence. Examples include recent incidents in Portland, Oreg., Aurora, Colo., Minneapolis, Minn., Brookfield, Wis., Tucson, Ariz., Norcross, Ga., Columbus, Ohio, and many other places. The tragic loss of human life and sorrow caused to survivors of each of these incidents is incalculable.

There is also good reason to believe that these crimes will continue. Instances of armed violence in schools and workplaces have increased over the past ten years with no sign of abating.

While many agree that these crimes can be prevented, a wide variety of structural reasons have made prevention difficult. Attempts to curb access to firearms have been successfully resisted for many years through both legal challenges to gun control laws and through political channels. Placing armed guards in schools and workplaces is both impractical and probably ineffective against a determined, well-armed foe with little or no interest in surviving the incident. Arming teachers or office workers inexperienced with firearms or public safety may only increase the number of gun-discharge accidents and, paradoxically, provide guns to those who end up using them for further criminal violence. Attempts to incarcerate or hospitalize the mentally disturbed may violate legal rights and due process standards.

Technical approaches to the problem are also possible but so far have met with little success or acceptance. For example, it is possible to construct doors and windows out of armored or bullet-resistant materials, but the cost and inconvenience of installing or retrofitting such materials are generally too great for most schools and workplaces. (Even if the installation of fortified doors and windows were economically feasible, it is likely that teachers, parents, students and office workers would resist this measure, as the doors are heavy, not easily opened or closed and turn an otherwise open and inviting school or office environment into something resembling a prison or military installation.)

It is also possible to construct common office and classroom furniture pieces with armored, bullet-resistant panels—such as a desk or lecture podium with an armored panel. These types of furniture pieces, however, provide little or no protection against a well-armed opponent willing to shoot any available target within a classroom or office space. Further, these furniture pieces only provide limited protection to those individuals who are able to get to and hide or position themselves behind the piece of furniture. These furniture pieces do not restrict an intruder from entering the room, thereby allowing the intruder to walk up to the individuals hiding behind the furniture piece and shooting from a position where protection is no longer afforded. Even if the furniture piece were able to protect the few who were fortunate to take cover behind it, the remaining persons in the room would be completely unprotected and vulnerable.

What is needed, instead, is a relatively inexpensive, unobtrusive and yet easily deployed device for securing a room, such as a classroom or office space, against a determined, perhaps well-armed foe. It is desirable that the device should fit into the normal environment of a classroom or office such that its appearance in the room does not alarm the room's occupants. Preferably, the device should also be able to function as a normal piece of furniture. These and other objects are embodied in the invention described and claimed below.

SUMMARY OF THE INVENTION

A furniture piece can be constructed that includes an armored or bullet-resistant panel, such as a bookcase or wardrobe with an armored or bullet-resistant back panel. The furniture piece may also be sized so that, when positioned in the doorway of a classroom or office, the furniture piece covers all or substantially all the doorway for that room. The furniture piece may also include wheels, rollers, rolling treads, or skids to allow the piece to be repositioned easily from its normal place in the room to a position blocking the room's doorway. The furniture piece may also include a mechanism for securing the furniture piece to the doorway or surrounding wall, such as a hook and eyelet, latch, cable, bolt, bar or other common locking mechanism. By this means, the furniture piece can be quickly locked into a position that covers all or substantially all the doorway of a classroom or office.

As an illustration, a bookcase embodying the current invention may be used as follows. The bookcase would be positioned in a location within a classroom or office that served the needs of the teacher, students or others, such as against a wall or by the teacher's desk. The mechanism for locking the bookcase to a doorway might be hidden on the side, back or top surface of the bookcase, while the wheels or roller mechanism might be recessed and hidden within the bottom of the bookcase. The bookcase might be used for many years (even its entire functional life) without ever being repositioned and used for protection against a hostile intruder.

Upon hearing an alarm that a hostile intruder, armed or unarmed, is loose in the school building or office, a person in the room might engage a lever on the side of the bookcase that lowers and locks into place the wheels or roller mechanism needed to move the bookcase from its normal position to a location blocking the room's doorway. Preferably, the mechanism would permit a teacher or other person to move the bookcase quickly by himself or herself and without the need for additional adults to assist in the process. The bookcase might also use fixed wheels, rollers or skids to assist in the process of repositioning the bookcase. The bookcase might also have standard legs or a bottom surface with no added mechanism for mobility. After moving the bookcase to a position blocking the doorway to the classroom, the teacher or other person would engage the latches, hook-and-eyelet system, steel cable or other mechanical means for locking the bookcase into its position. The teacher, students and others in the room—now securely locked into the room—would then await the arrival of law enforcement or signal for all clear.

A hostile assailant who attempts to get into the classroom or other room might be able to shoot through a normal, non-reinforced door but would not be able to shoot through the armored panel secured to and covering the doorway according to the invention. The assailant might also try to kick or push through the door, and so preferably the mechanism for locking the bookcase or other furniture piece to the doorway would be reinforced and of strength sufficient to withstand strong kicking and pushing from outside, such as a steel-reinforced cable with hooks or carabiners at either end. The hooks would then lock into eyelets secured into the wall studs, brick or cinderblock around the doorway. By this means, the bookcase or furniture piece would be locked into position using an inexpensive, unobtrusive and easily deployed mechanism that is difficult to defeat from outside the classroom. The locking mechanism may also include chains, cables, metal rods or bars, barricades, deadbolts, cremone bolts and other multipoint bolting systems. The locking mechanism may be secured to the door, the door frame, the doorway and its surrounding structure, the walls nearby the doorway and their surrounding structure, the floor, the ceiling or any combination of these.

In another embodiment of the invention, the furniture piece might be a wardrobe, a large wall hanging such as a map, chalkboard, whiteboard or posterboard or a desk with a large, flat top surface. The furniture piece should be able to be repositioned from its normal location within the classroom or office to a position where it is blocking all or substantially all the doorway to the room. The furniture piece includes one or more armored or bullet-resistant panels such that, when the piece is repositioned to block the doorway to the room, the armored or bullet-resistant panels will block shots fired into the doorway or other dangers from outside.

Armored, bullet-resistant or ballistic-resistant materials are described at length in U.S. patent application Ser. No. 13/197,957, to Peters (U.S. Pub. No. 2012/0152096 A1, published Jun. 21, 2012), U.S. patent application Ser. No. 13/341,278, to Peters (U.S. Pub. No. 2012/0247313 A1, published Oct. 4, 2012), U.S. patent application Ser. No. 09/884,656, to Durst et al. (U.S. Pub. No. 2003/0008097 A1, published Jan. 9, 2003), and U.S. patent application Ser. No. 12/905,900, to Sudhakar (U.S. Pub. No. 2012/0090452 A1, published Apr. 19, 2012), all of which are incorporated herein by reference for all purposes. Other materials known and used to provide resistance or protection from projectiles, bullets, weapons or other dangers may not be listed in these references but are within the scope of this invention. Armored, bullet-resistant or ballistic-resistant materials may or may not satisfy a technical standard for bullet-resistance or protection, such as for example Underwriters Laboratory Bulletin #752 (which describes eight levels of ballistic-resistant material) but are all within the scope of this invention.

DESCRIPTION OF THE DRAWINGS

The advantages of this invention will be more readily apparent from the following description of the drawings in which.

DESCRIPTION OF THE PREFERRED EMBODIMENTS

Figure 1:
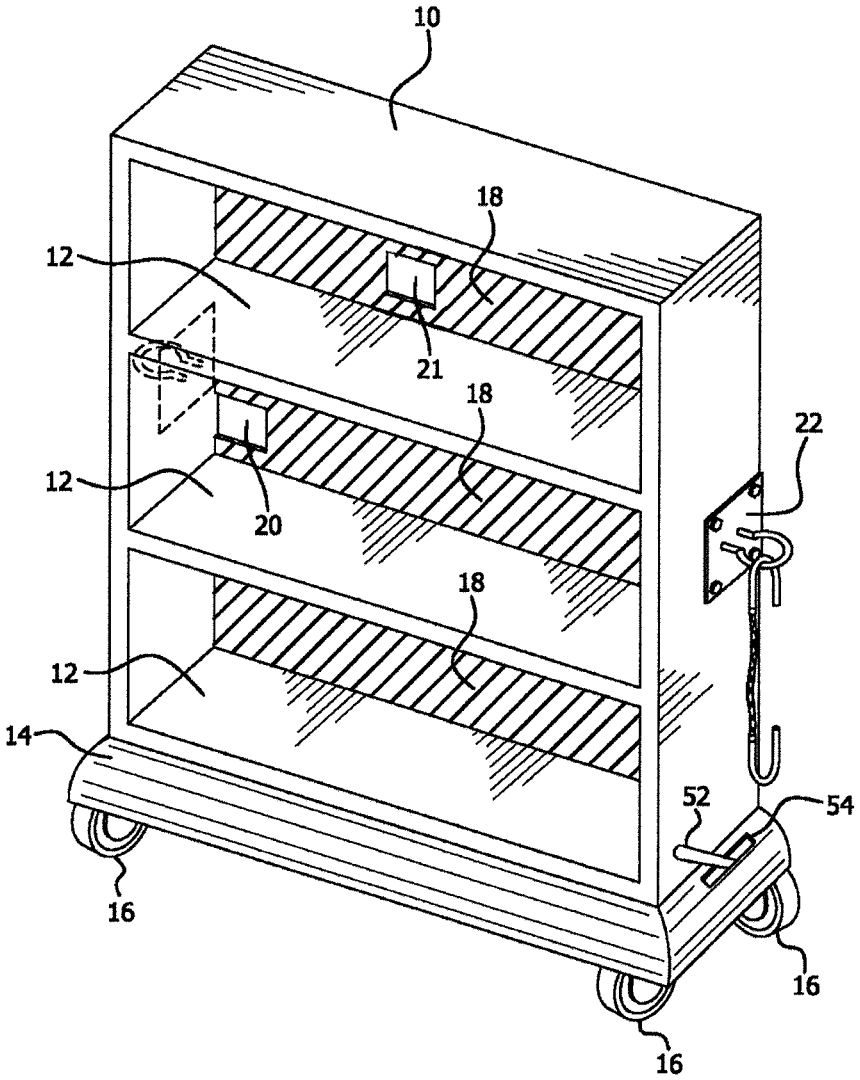
FIG. 1 is a right front perspective view of a first embodiment of a bookcase according to the invention.

Referring first to FIG. 1, a bookcase 10 according to the present invention is shown. The bookcase may have shelves 12 for storing books and other items that might be present in a typical classroom, office or other location where the bookcase might be in use. Other arrangements or configurations of shelves, cabinets, doors are possible and within the scope of the invention. Below the shelves 12 may be a base or plinth 14 used to conceal, either partially or completely, wheels or casters 16 for moving the bookcase from its normal position to a location blocking the doorway to the room. The rear panel of the bookcase 18 includes armored, bullet-resistant or ballistic resistant material, either alone or in combination with other materials. The bookcase may include a doorknob recess, opening or cutout 20 to allow the bookcase to be positioned flush against a door without interference from the doorknob or handle. A locking mechanism 22 is also illustrated for securing both sides of the bookcase to the door frame, doorway or wall when the bookcase is being used to block the doorway to the room. The bookcase base 14 may also include an opening 54 and a lever or control handle 52 for engaging or retracting the wheels 16 at the bottom of the bookcase. Having retractable wheels at the bottom of the bookcase may be advantageous, since the bookcase according to the invention is preferably constructed to appear and function as a typical bookcase.

Besides a bookcase 10, other items of furniture (not shown) may also be constructed in accordance with the invention, including without limitation a wardrobe, a cabinet, a storage container, a shelf system, a large wall hanging such as a map, chalkboard, whiteboard or poster board or a desk or table with a large, flat top surface. The furniture piece may be constructed from wood, resin, metal, fiberboard, plastic, composites, carbon fiber or any other materials known and used for construction of such items.

The panel 18 of armored, bullet-resistant or ballistic-resistant material may similarly be constructed from steel, titanium or other metals, fiberglass, composites, resins, carbon fiber, KEVLAR® and other aramid fibers, boron carbide, silicon carbide, aluminum oxide, glass, plastic and any other materials known and used for construction of such items. The terms "armored," "bullet-resistant" and "ballistic-resistant" are used interchangeably herein and do not refer to any particular technical standard for bullet-resistance, puncture-resistance or similar protection, such as for example Underwriters Laboratory Bulletin #752 (which describes eight levels of ballistic-resistant material). Instead, all materials known and used for providing any level of protection or resistance to bullets, ballistics, puncturing, stabbing, piercing or cutting from any type of weapon are within the scope of this invention.

The panel 18 of armored material may also include an opening or hole 21 to be used as a viewing port. An occupant in the room might use the viewing port for looking through the armored back panel to check on the identity of someone seeking to enter the room or to see what is happening outside the blocked entrance to the room. Preferrably the viewing port is aligned with the typical location of a door's view window so that the occupant can remain behind the armored panel and look through the viewing port to see outside the room's entrance. The viewing port may be installed in the armored panel when the furniture piece is originally manufactured or may be cut into the armored panel when the furniture piece is installed in its intended location. The viewing port may be a traditional apartment or hotel door "peep hole" or a larger opening that may or may not be covered.

The panel 18 of armored material may also be constructed so that it can be extended or expanded to cover a larger area than it would in its normal, collapsed or "storage" configuration. For example, on either side of the furniture piece 10, a second and third armored panel (not shown) would also be attached with locking hinges. In its normal, "storage" configuration, the additional panels might be positioned so that they appear to be part of a normal piece of furniture. But when the furniture piece is locked into a position blocking the entrance to the room, the second and third armored panels might be folded outwards and locked into their "extended" position, thereby blocking the narrow, vertical side-light windows sometimes used with certain doors. In this way, the entire entrance way to the room may be blocked, including the door itself and any accompanying side-light windows, with an armored panel.

The doorknob opening or cutout 20 shown in FIG. 1 may also be constructed as a partially or completely enclosed concavity or recess (not shown) in the rear panel 18 and other parts of the furniture piece. The doorknob would fit within the concavity or recess when the furniture piece was positioned next to the door, and the concavity or recess would partially or completely enclose or surround the doorknob, preferably with some form of armored or bullet-resistant materials. The concavity or recess might be formed entirely in the armored panel 18 or might be formed with changes in the shape or dimensions of the armored panel, shelves 12, side panels and other parts or elements of the furniture piece 10. Enclosing the doorknob within an armored or bullet-resistant recess may have an advantage in stopping or inhibiting a bullet fired at the doorknob from the other side of the door. The terms "doorknob," "door handle," "knob" and "handle" are used interchangeably herein and refer to door knobs, door handles, door levers, door locks, window handles, window pulls and any other type of knob, handle or mechanism that protrudes from a door, window or other opening, entrance or entryway to a room.

The wheels or casters 16 shown in FIG. 1 may be any type of mobility mechanism known and used for enabling the repositioning or improving the mobility of a furniture piece. The mobility mechanism may be fixed or retractable, as shown in FIG. 1. Among many other examples, the furniture piece may include rollers, cylinders, balls, wheels, spheres or similar shapes of any kind that would permit the piece to be rolled or repositioned more easily in the case of an emergency. In addition to or instead of a rolling mechanism, the furniture piece may include smooth skids or slides to relieve friction between the furniture piece and the floor and thereby facilitate movement of the furniture piece. Other known examples of rolling or mobility mechanisms for furniture are all within the scope of the invention.

Figure 2:
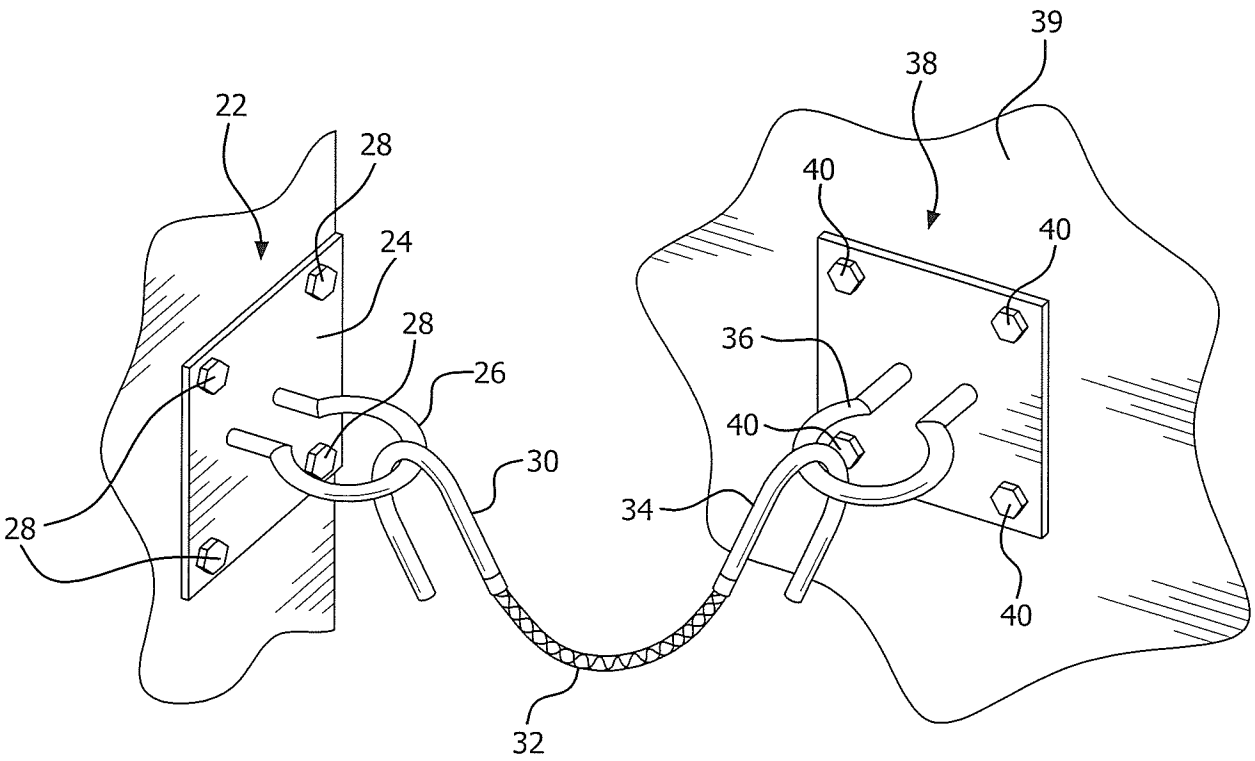
FIG. 2 is a side and front perspective view of a mechanism for locking the bookcase of FIG. 1 to a wall or doorframe.

Referring next to FIG. 2, a locking mechanism 22 for the bookcase 10 of FIG. 1 is illustrated in greater detail. The locking mechanism 22 includes a reinforced plate 24 of metal or other material designed to withstand a force applied to it, the plate 24 being secured to the side of the bookcase 10 with reinforced fasteners or bolts 28. Attached to the plate 24 is a reinforced ring or eyelet 26 to which one may attach a hook 30 of a hook-and-cable piece 32. The other hook 34 may be attached to a reinforced ring or eyelet 36 mounted on a similar, reinforced plate 38 attached to the door frame, doorway or nearby wall 39 using reinforced fasteners 40. A similar locking mechanism 22 would be located on the opposite side of the furniture piece so that both sides could be secured to the door frame, doorway or nearby wall, thereby preventing entry into the room even against the determined efforts of an armed intruder.

Figure 3:
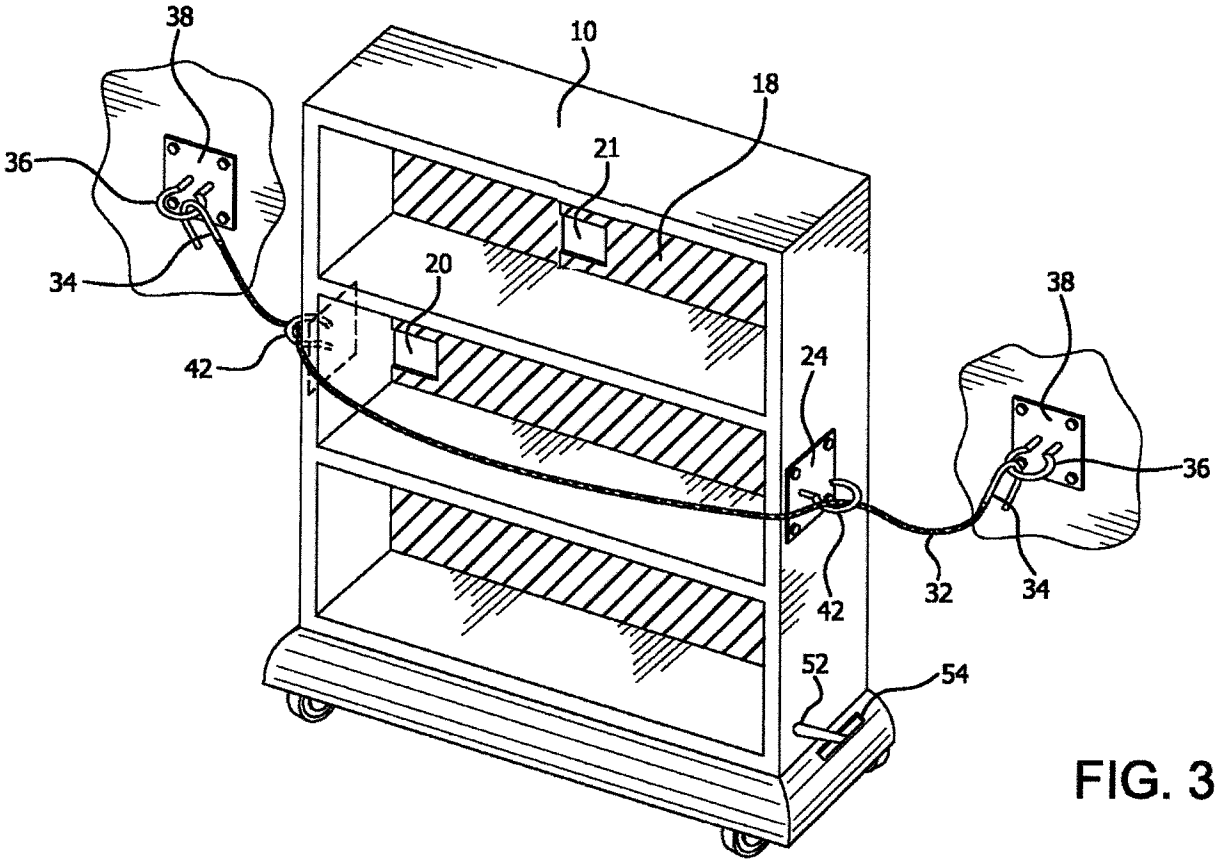
FIG. 3 is a right front perspective view of a second embodiment of a bookcase according to the invention.

Many other arrangements or configurations of a locking mechanism 22 are possible, all of which are within the scope of the invention. Among many other examples, the locking mechanism can include chains, cables, metal rods or bars, barricades, deadbolts, cremone bolts and other multipoint bolting systems. The locking mechanism may be secured to the door, the door frame, the doorway and its surrounding structure, the walls nearby the doorway and their surrounding structure, the floor, the ceiling or any combination of these. In fact, the furniture piece may include a number of alternative locking mechanisms to enable the piece to be used with a variety of differently configured rooms, doors and doorways. The locking mechanism's hooks 30, 34 may be simple, open hooks as depicted in FIGS. 1-3 or may further include a spring-loaded gate or retaining mechanism, such as a carabiner. The locking mechanism may include a metal bar or bars that are secured to the furniture piece and sized to fit securely within a receiving hole in the floor, walls or ceiling of the room. All configurations of mechanical locks, bolts, chains, cables, bars, rods or barricades are within the scope of the invention.

Referring next to FIG. 3, an alternative locking mechanism for the bookcase 10 of FIG. 1 is illustrated. In this embodiment, the hook-and-cable piece 32 is sized so that it can reach around the entire width of the bookcase 10 and be secured with hooks 34 into reinforced rings or eyelets 36 attached to plates 38 mounted to the door frame, doorway or wall on either side of the bookcase 10. To keep the hook-and-cable piece in position when locked, the bookcase 10 also includes reinforced hooks 42 mounted to plates 24 secured to the sides of the bookcase. Using this configuration, the bookcase could be quickly and securely fastened to the door and doorway, thereby covering (either partially or completely) an otherwise vulnerable entryway to the room with an armored panel 18.

Figure 4:
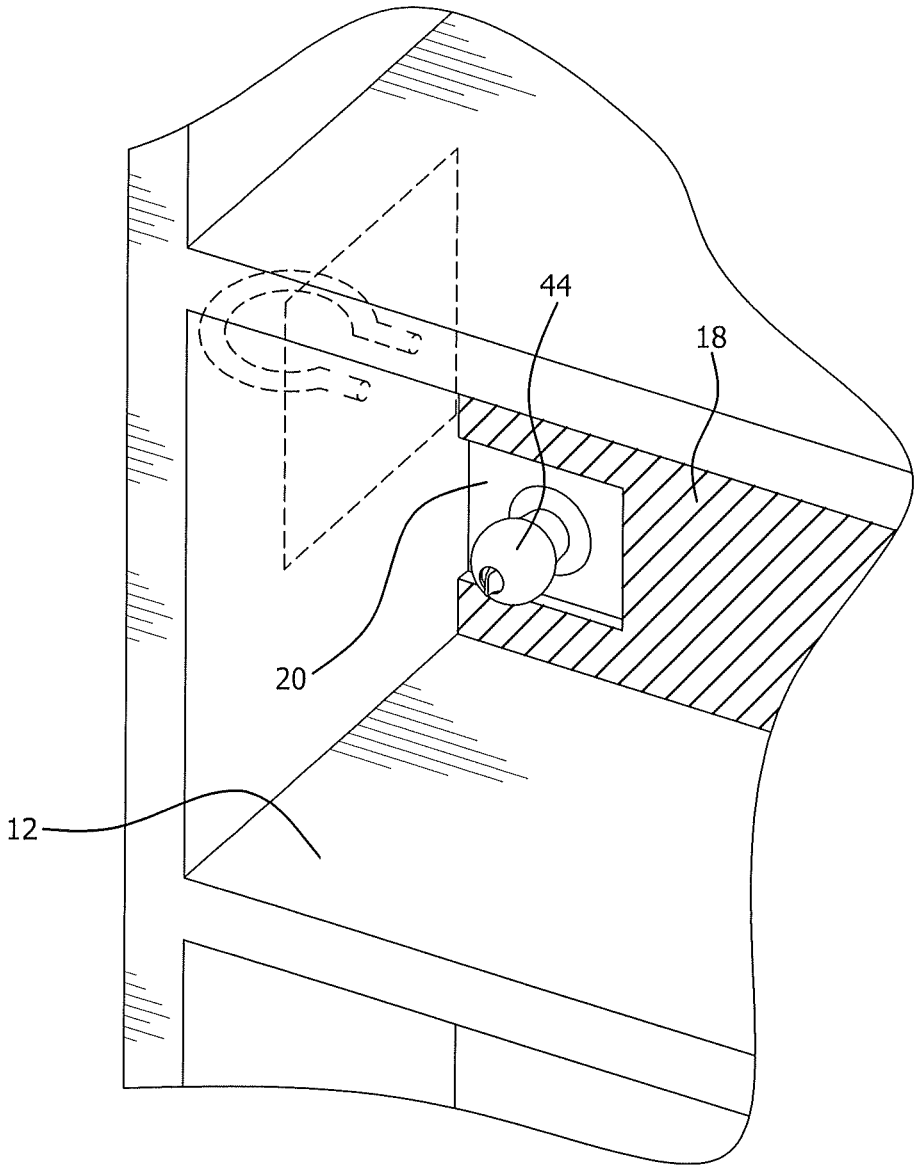
FIG. 4 is a right front perspective view of a doorknob cut-out for the bookcases of FIGS. 1 and 3.

Referring next to FIG. 4, the doorknob opening or cutout 20 for the bookcase 10 of FIGS. 1 and 3 is illustrated in greater detail. The doorknob opening 20 permits the bookcase to be positioned and locked substantially flush against an existing doorway with the doorknob or door handle 44 protruding through the opening in the bookcase's rear panel 18. Preferably, the bookcase's shelves 12 may be adjustable in height or removable so that the shelves can be positioned or removed so as not to block the knob or handle 44. The opening 20 may be created in the rear panel 18 when the bookcase is originally manufactured, or the opening may be created later when the bookcase is being installed in a particular room to accommodate the position of the doorknob or door handle for that room.

Figure 5:
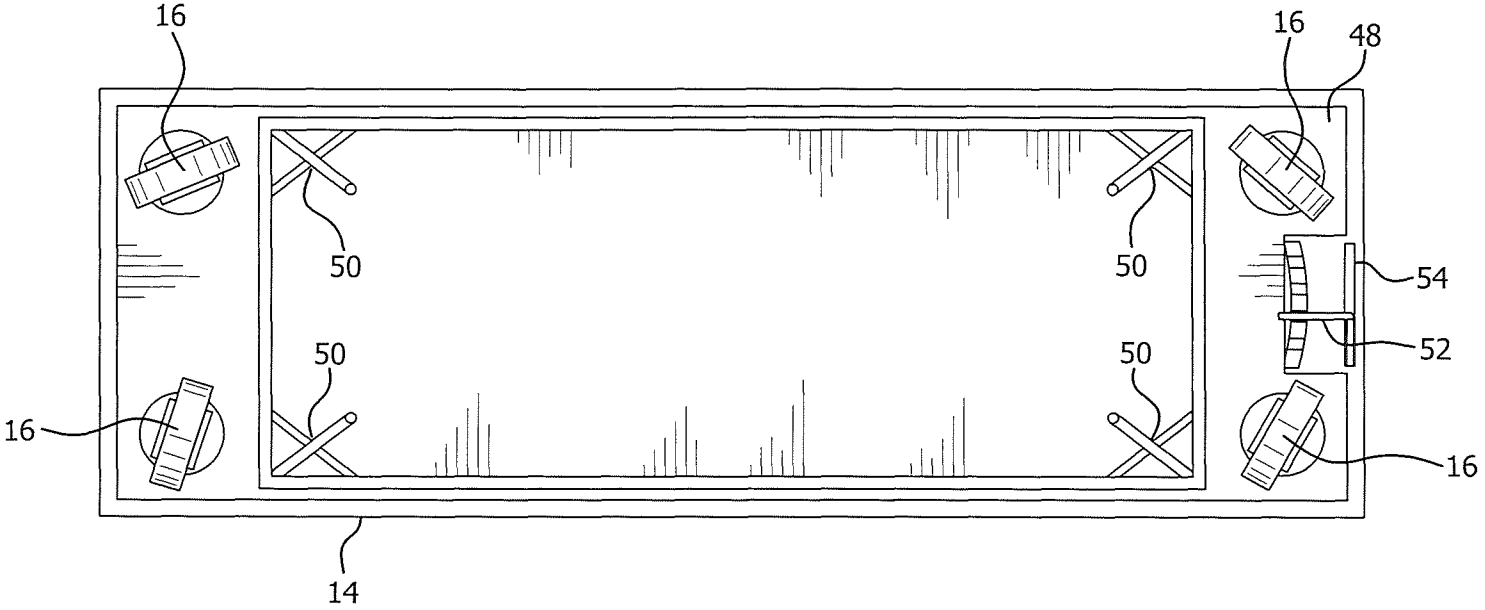
FIG. 5 is a bottom elevational view of a retractable chassis and wheels for the bookcases of FIGS. 1 and 3.

Referring finally to FIG. 5, the bottom of the bookcase 10 of FIGS. 1 and 3 is illustrated in greater detail in a bottom elevational view. The four wheels or casters 16 are mounted to a supporting chassis 48 in a manner that permits them to swivel as the bookcase 10 is being moved. The chassis 48 is attached to the underside of the bookcase through moveable or extendable support pieces 50 that can retract the chassis 48 either partially or completely within the bookcase's base or plinth 14. The chassis 48 is also attached to a lever or control handle 52 that extends through an opening 52 in the base 14. Moving the lever or control handle from a first position to a second position causes the support pieces 50 and the chassis 48 to extend a position from within the bookcase's base 14 such that the wheels or casters 16 are in contact with the floor beneath the bookcase 10 and supporting the bookcase's weight. Preferably the lever or control handle also includes some form of lock, latch or engagement so that the chassis 48 and wheels 16 can be fixed or locked in this "engaged" position. In this manner, an occupant in the room would be able to pull the lever or control handle 52, lower and lock the wheels into their lowered, engaged position, and then roll the bookcase 10 on its wheels to a position substantially flush against the door or doorway of the room, where it can then be locked into position with the locking mechanism 22 (not shown).

The invention has been illustrated by detailed description and examples of the preferred embodiments. Various changes in form and detail will be within the skill of persons skilled in the art. Therefore, the invention must be measured by the claims and not by the description of the examples or the preferred embodiments.

I claim:

1. A furniture piece for substantially blocking at least one entrance of a room, comprising at least one armored panel;

at least one locking mechanism; and means for releasably securing the furniture piece, using the at least one locking mechanism, to a location adjacent to and substantially blocking the at least one entrance of the room;

wherein the furniture piece is moveable from a location within the room and not adjacent to the at least one entrance of the room to the location adjacent to and substantially blocking the at least one entrance of the room.

2. The furniture piece of claim 1, further comprising at least one furniture mobility mechanism.

3. The furniture piece of claim 2, wherein the at least one furniture mobility mechanism is selected from the group consisting of: a wheel, a caster, a roller, a bearing, a sphere, a hemisphere, a cylinder, a skid and a slide.

4. The furniture piece of claim 2, wherein the at least one furniture mobility mechanism is selectable between a first "storage" position and a second "mobility" position, the second "mobility" position configured to assist in repositioning the furniture piece to the location adjacent to and substantially blocking the at least one entrance of the room.

5. The furniture piece of claim 1, wherein the furniture piece is selected from the group consisting of: a bookcase, a wardrobe, a cabinet, a storage container, a shelf system, a wall hanging, a chalkboard, a whiteboard, a poster board, a desk and a table.

6. The furniture piece of claim 1, wherein the at least one armored panel further comprises material selected from the group consisting of: steel, titanium, fiberglass, aramid fiber, carbon fiber, boron carbide, silicon carbide, aluminum oxide, glass and plastic.

7. The furniture piece of claim 1, wherein the at least one locking mechanism further comprises at least one hook and at least one ring.

8. The furniture piece of claim 7, wherein the at least one hook further comprises a gate mechanism.

9. The furniture piece of claim 1, wherein the at least one armored panel defines an opening positioned such that a handle associated with the at least one entrance of the room protrudes at least partially through the opening when the furniture piece is secured to the location adjacent to and substantially blocking the at least one entrance of the room.

10. The furniture piece of claim 1, where in the at least one armored panel defines a cavity positioned such that a handle associated with the at least one entrance of the room is contained at least partially within the cavity when the furniture piece is secured to the location adjacent to and substantially blocking the at least one entrance of the room.

11. The furniture piece of claim 1, wherein the at least one armored panel further comprises a viewing port.

12. The furniture piece of claim 1, wherein the at least one locking mechanism further comprises a metal rod.

13. A method for substantially blocking at least one entrance of a room, comprising:

repositioning a furniture piece comprising at least one armored panel from a first location in the room and not adjacent to the at least one entrance of the room to a second location adjacent to and substantially blocking the at least one entrance of the room; and releasably securing the furniture piece to the second location using at least one locking mechanism.

14. The method of claim 13, wherein the furniture piece further comprises at least one furniture mobility mechanism.

15. The method of claim 14, wherein the at least one furniture mobility mechanism is selected from the group consisting of: a wheel, a caster, a roller, a bearing, a sphere, a hemisphere, a cylinder, a skid and a slide.

16. The method of claim 14, wherein the at least one furniture mobility mechanism is selectable between a first "storage" position and a second "mobility" position, the second "mobility" position configured to assist in repositioning the furniture piece to the second location adjacent to and substantially blocking the at least one entrance of the room.

17. The method of claim 13, wherein the furniture piece is selected from the group consisting of: a bookcase, a wardrobe, a cabinet, a storage container, a shelf system, a wall hanging, a chalkboard, a whiteboard, a poster board, a desk and a table.

18. The method of claim 13, wherein the at least one armored panel further comprises material selected from the group consisting of: steel, titanium, fiberglass, aramid fiber, carbon fiber, boron carbide, silicon carbide, aluminum oxide, glass and plastic.

19. The method of claim 13, wherein the at least one locking mechanism further comprises at least one hook and at least one ring.

20. The method of claim 19, wherein the at least one hook further comprises a gate mechanism.

21. The method of claim 13, wherein the at least one armored panel defines an opening positioned such that a handle associated with the at least one entrance of the room protrudes at least partially through the opening when the furniture piece is secured to the second location adjacent to and substantially blocking the at least one entrance of the room.

22. The method of claim 13, wherein the at least one armored panel defines a cavity positioned such that a handle associated with the at least one entrance of the room is contained at least partially within the cavity when the furniture piece is secured to the second location adjacent to and substantially blocking the at least one entrance of the room.

23. The method of claim 13, wherein the at least one armored panel further comprises a viewing port.

24. The method of claim 13, wherein the at least one locking mechanism further comprises a metal rod.

* * * * *